United States Patent [19]

Marchiori et al.

[11] Patent Number: 4,870,815

[45] Date of Patent: Oct. 3, 1989

[54] METHOD TO WIND DOWN A YARN PACKAGE AND DEVICE TO PERFORM THE METHOD

[75] Inventors: Mirko Marchiori, Pordenone; Danny Lant, Basiliano; Fabio Lancerotto, Milan; Umberto Gerin, Pordenone, all of Italy

[73] Assignee: Cerit SpA, Pordenone, Italy

[21] Appl. No.: 174,877

[22] Filed: Mar. 29, 1988

[30] Foreign Application Priority Data

Apr. 3, 1987 [IT] Italy ..... 83346 A/87

[51] Int. Cl.[4] ..... D01H 1/38

[52] U.S. Cl. ..... 57/299; 57/278; 57/303; 242/18 EW

[58] Field of Search ..... 57/276, 277, 278, 299, 57/303; 242/18 PW, 18 EW

[56] References Cited

U.S. PATENT DOCUMENTS

| | | | |
|---|---|---|---|
| 2,747,359 | 5/1956 | Keefe, Jr. | 57/299 |
| 3,186,154 | 6/1965 | Negishi | 57/303 X |
| 3,210,922 | 10/1965 | Winter | 57/303 X |
| 3,263,409 | 8/1966 | Zuidema | 57/299 |
| 3,339,356 | 9/1967 | Nikel et al. | 57/303 X |
| 3,491,526 | 1/1970 | Krauss et al. | 57/278 X |
| 3,778,996 | 12/1973 | Olson et al. | 57/299 X |
| 3,841,074 | 10/1974 | Wachendorf et al. | 57/299 X |

FOREIGN PATENT DOCUMENTS

| | | |
|---|---|---|
| 2193100 | 2/1974 | France . |
| 2461034 | 1/1981 | France . |
| 2498637 | 7/1982 | France . |

*Primary Examiner*—John Petrakes

*Attorney, Agent, or Firm*—Wegner & Bretschneider

[57] ABSTRACT

The invention concerns a spinning machine having a spindle with which to rotate a yarn package, a winding apparatus to wind the yarn on the package, and drafting rolls to feed the yarn to the winding apparatus. According to the disclosed method, the winding down of the yarn on the package is achieved by reversing the rotation of the spindle relative to the spinning direction. according to the disclosed device, a spacer ring is employed which is fixed to the spindle, and which has an upper and a lower hollow, a protruding edge, and substantially sharp edges which aid in cutting the yarn.

15 Claims, 3 Drawing Sheets

METHOD TO WIND DOWN A YARN PACKAGE AND DEVICE TO PERFORM THE METHOD

Figure 1C:
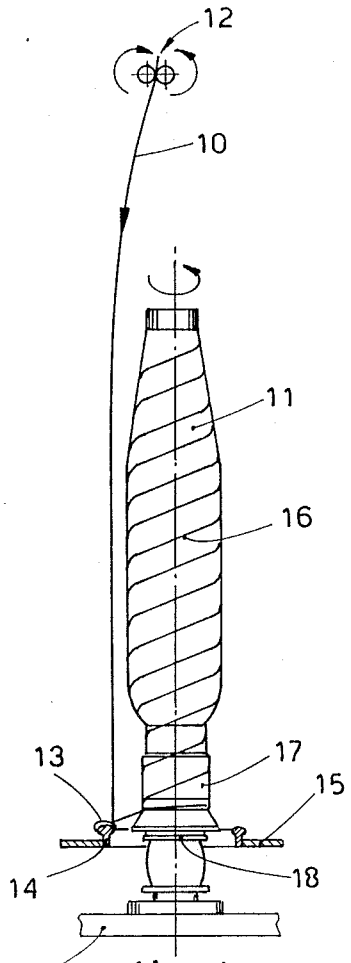

This invention concerns a method for winding down a yarn package and a device for performing such a method. To be more exact, the invention concerns a method, and the relative device to perform the method, which together are suitable for winding down yarn below a yarn package.

When the formation of a yarn package on ring spinning machines has ended, the operation of winding down the yarn below the yarn package follows more specifically winding the underwiding yarn, on an underwinding sleeve rotatably fitted on the spindle.

During the winding down process some coils of yarn are wound on the spindle, thus the yarn is held at that position.

When winding down has taken place, the full yarn package can be doffed and a new tube donned, the yarn thus remaining is already arranged for the next start-up of the spinning machine.

On ring spinning machines the winding down operation takes place by lowering the ring rail from the upper end of the yarn package to the base of the spindle at a level corresponding with a suitable tract of the spindle. This tract where the coils of yarn are wound, is normally called the "underwinding sleeve".

Traditionally during the winding down process the spinning machine continues spinning. The yarn arrives from the drafting unit and is wound in descending coils on the body of the yarn package first and then is wound on the underwinding sleeve of the spindle.

If the ring rail is lowered while the spinning machine is working, the winding element, the ring and traveller for instance, must be coaxial with the yarn package and have a radial dimension greater than the diameter of the package.

When the ring rail has been lowered, the yarn package is free to be doffed.

After the doffing by hand or with automated devices, the yarn is broken between the yarn package and the winding down coils on the underwinding sleeve. Some descending coils called "winding down coils" remain on the yarn package.

The winding down coils on the underwinding sleeve are wound in the same direction of rotation as the coils of yarn wound on the yarn package.

During the winding down the yarn package is rotated in the same direction as during spinning.

In practice the traditional winding down operation is the last step in the spinning process before the machine is stopped. The yarn required for the winding down step is supplied until the last moment by the drafting unit.

If the winding element on a spinning machine has a radial dimension smaller than the diameter of the yarn package, it is impossible to lower the element along the axis of the package and thus it becomes necessary to displace the element beforehand from that axis.

However, in this situation it is no longer possible to carry on spinning and therefore no yarn will arrive from the drafting unit during the step of lowering the ring rail and winding down.

To perform a traditional winding down operation in this situation, it is necessary to provide spare yarn before performing the winding down process.

Therefore, the number of winding down coils which can be laid on the underwinding sleeve will depend on the length of spare yarn provided.

The length of the segment of spare yarn has to be sufficiently long to provide a safe winding down operation and to provide good anchorage of the yarn on the spindle sleeve. More specifically, good anchorage of the spare yarn during the winding down process will ensure the breakage of even the strongest yarns when the yarn package is doffed.

To obviate such drawbacks and obtain a plurality of advantages the present applicant has designed, tested and embodied a new method for winding down a yarn package and has designed a device suitable to perform such a method.

According to the invention the new method obviates the necessity of feeding yarn from the drafting unit during the winding down process. The new method also obviates the necessity to provide spare yarn, previously necessary when the diameter of the winding element is smaller than the diameter of the yarn package, before performing the winding down process.

The invention enables the yarn needed for formation of the winding down coils to be taken from the yarn package at the same time as the formation of these coils.

According to the invention the direction of rotation of the spindle during the winding down process is opposite to the direction of rotation during the spinning process.

A further advantage of the invention is the fact that the winding down coils on the underwinding sleeve are wound in an opposite direction to that of the coils made during spinning and therefore tend to become unravelled automatically with an increase in the speed of rotation of the spindle when the machine is started up again.

By means of the invention it is also possible to wind any desired number of winding down coils on the underwinding sleeve and to apply a constant and very restricted tension to the yarn throughout the whole winding down process.

For this purpose the underwinding sleeve is rendered able to idle on the spindle and to cooperate with a spacer ring solidly fixed to the spindle.

Such an embodiment enables many winding down coils to be wound, even with very thin, weak yarns.

The new method can therefore be employed with any type of winding device. For example, it can be advantageously employed with winding devices having radial dimensions smaller than the diameter of the yarn package.

With the winding down method of the present invention the loose end of the yarn package when doffed will be shorter, since the winding down coils are not formed on the yarn package, thus, yarn is conserved.

Moreover, the breakage of the yarn will be localised at the sharp edge of the spacer ring, therefore enabling easy location of the yarn end when winding starts.

According to the invention the following steps are entailed.

When the yarn package is complete, the spinning machine is stopped and the spindles and drafting unit halt.

The yarn goes from the drafting unit to the winding means and is then wound on the yarn package.

The yarn package is then rotated in the opposite direction to the spinning direction, and at the same time the segment of yarn about to be wound on the yarn package is diverted and lowered to a determined position at about the lower end of the underwinding sleeve.

Such diversion of the yarn is made possible by the unwinding of yarn from the package owing to rotation in the reverse direction in cooperation with the winding means.

In a variant, the diversion of the yarn is obtained with the cooperation of the winding means and of other means able to position the yarn at the lower end part of the underwinding sleeve.

According to the invention the reverse rotation of the yarn package is ended when the winding down is completed.

During the reverse rotation of the yarn package the yarn is pulled by the package owing to its hairiness and is arranged on the surface of the package in a reverse arc.

As rotation proceeds, the yarn comes into contact with the outer edge of the spacer ring, passes over the ring and reaches the underwinding sleeve, on which it is wound.

An embodiment of this invention is a method to wind down a yarn package on a spinning machines comprising a spindle to rotate the yarn package, means to wind yarn on the yarn package and drafting rolls to feed the yarn, the method being characterized in that the winding down is achieved by reverse rotation of the yarn package in relation to the direction of rotation of the spinning step.

A further embodiment of this invention is a device for winding down yarn packages, which employs the above method and is characterized in that a spacer ring is fitted in a stationary manner on a spindle and comprises an upper annular hollow, a lower annular hollow, a protruding surface and a substantially sharp annular edges.

Figure 1B:
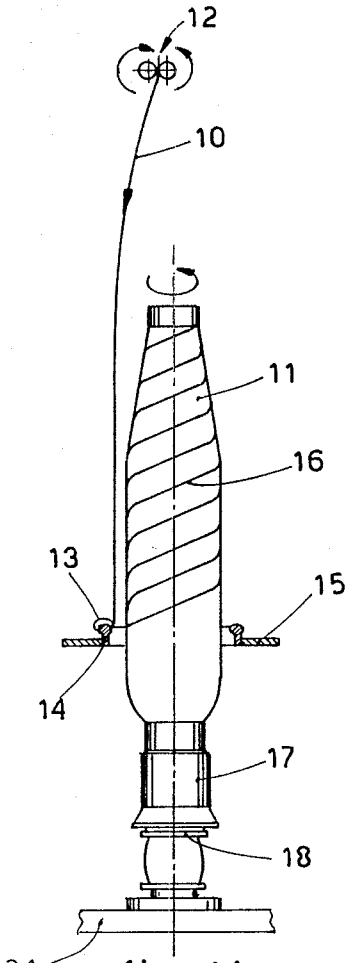
Figure 1A:
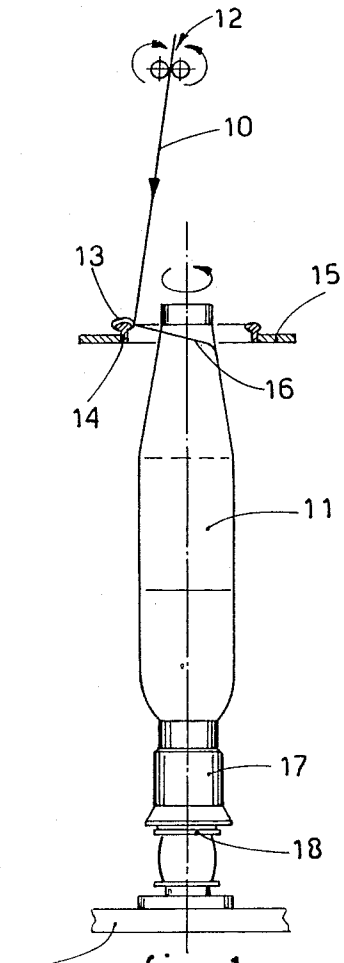

The attached figures, which are given as a non-restrictive example, show the following:

Figs.1*a*, 1*b* and 1*c* show the known art;

Figs.2*a*–2*e* and 3 show preferred embodiments of the invention.

Figs.1*a*, 1*b* and 1*c* show the operation of winding down a yarn 10 at the end of formation of a yarn package 11 on ring spinning machines, for instance.

The yarn 10 is fed by feeder rolls 12 of a drafting unit and is guided by a traveller 13 able to slide on a ring rail 15.

Descent of the rail 15 causes coils 16 of yarn 10 to be wound first on the body of the yarn package 11 and thereafter on an underwinding sleeve 17 as far as the base of a spinning spindle 18. Some coils 16 are wound on the sleeve 17 and held in that position.

When the yarn package 11 is doffed, the yarn 10 is broken in its segment between the yarn pacakge 11 and the winding down coils 16 lying on the underwinding sleeve 17.

Figs.2*a*, 2*b*, 2*c*, 2*d* and 2*e* show the steps of the winding down of the invention.

As an example, the method is shown as applied to a ring spinning machine but can be applied also to other spinning systems such as cap spinning frames and the like.

Figure 2C:
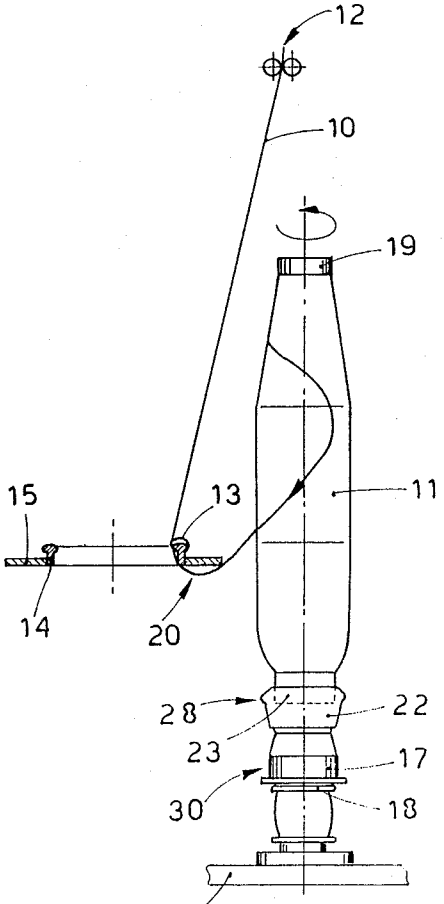
Figure 2B:
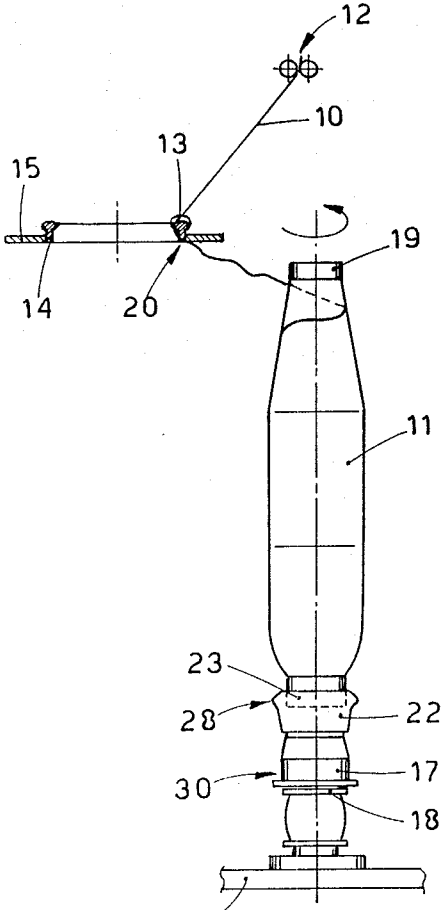
Figure 2A:
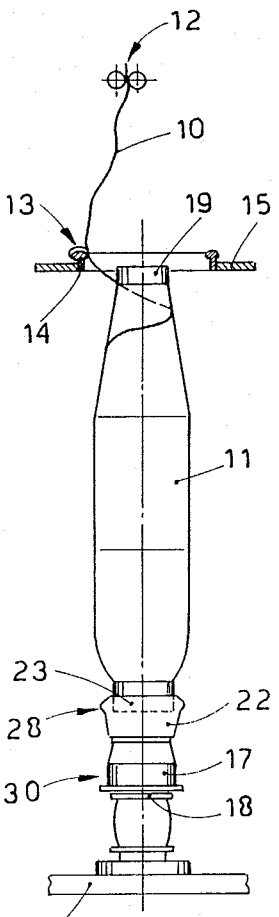

FIG. 2*a* shows the step of completion of the yarn package 11, with the ring rail 15 in a position corresponding to the upper end 19 of the package 11. The feed rolls 12 and spindle 18 are halted.

FIG. 2*b* shows the step in which the ring rail 15 is raised above the upper end 19 of the yarn package 11 and is displaced sideways in relation to the package 11.

In this step the spindle 18 begins to rotate in the opposite direction to the spinning direction.

The yarn 10 now comprises a divergent segment 20 owing to the sideways displacement of the ring rail 15 and the reversed rotation of the spindle 18.

FIG. 2*c* shows the descent of the ring rail 15 outside the yarn package 11.

Figure 2E:
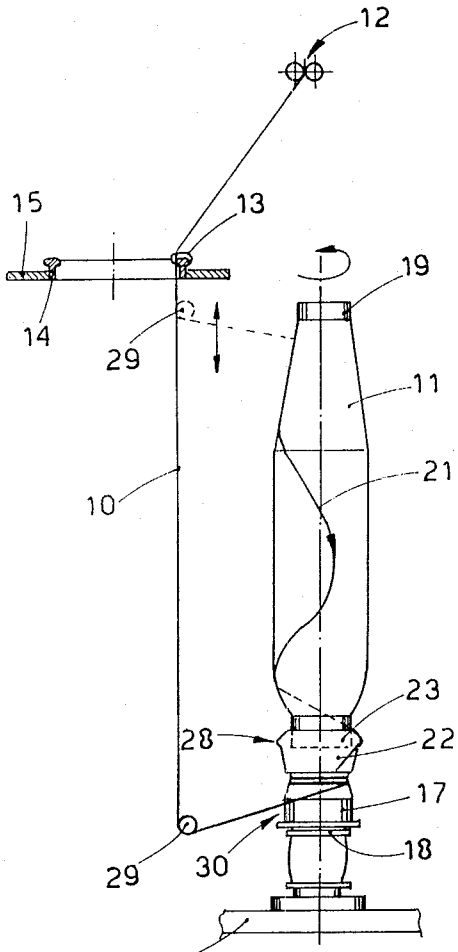
Figure 2D:
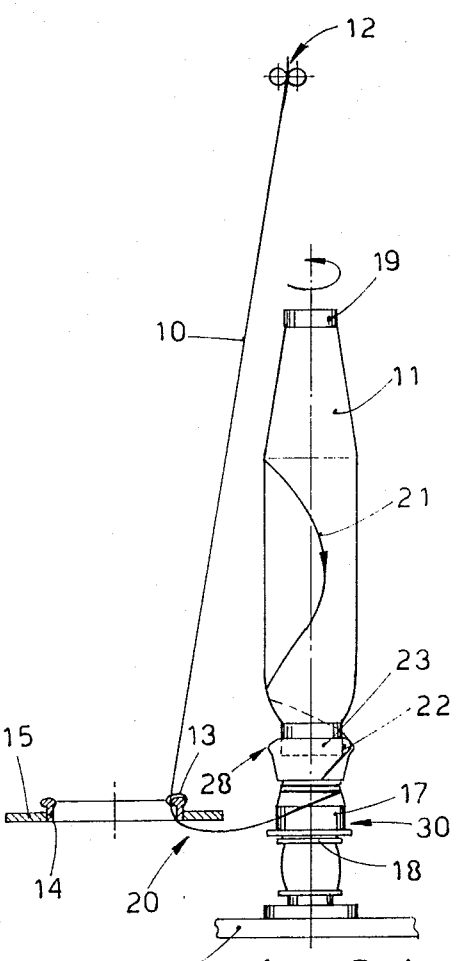

FIG. 2*d* shows the position of the lower end of the travel of the ring rail 15 in correspondence with the lower end portion 30 of the underwinding sleeve 17.

The yarn 10 is set in rotation by the hairiness of the yarn package 11 and becomes arranged on the body of the package in the form of an inverted arc 21.

A spacer ring 22 solidly fixed to the spindle 18 comprises an upper hollow 23 to accommodate the yarn package 11, thus reducing the distance between the first spinning coils 16 wound on the yarn package 11 and a protruding surface 28 of the spacer ring 22.

The yarn 10 runs momentarily on the protruding surface 28 of the spacer ring 22 and is wound thereafter on the underwinding sleeve 17.

FIG. 2*e* shows diagrammatically a variant for the diversion of the yarn 10.

A divertive element 29, which may be a pin or a lever or a similar element, cooperates momentarily with the yarn 10 by means of a drive unit positioned on the spinning machine and brings the yarn to a position corresponding with the lower end 30 of the underwinding sleeve 17.

Figure 3:
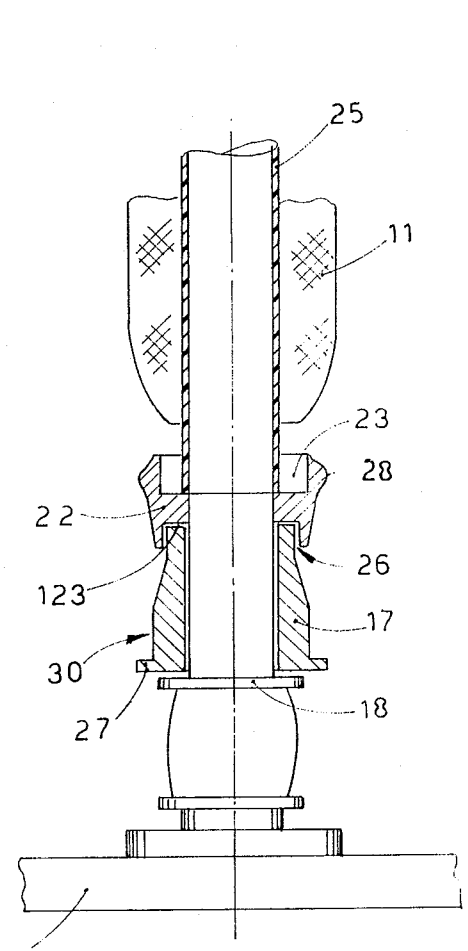

FIG. 3 gives an enlarged view of the lower end portion of the spindle 18 fitted to the spindle rail 24.

The tube 25 of the yarn package 11 rests its lower end in the upper hollow 23 machined in the upper portion of the spacer ring 22 solidly fixed to the spindle 18.

The spacer ring 22 comprises in its lower side a lower hollow 123 with substantially sharp edges so as to facilitate and localise the breakage of the yarn 10 when the yarn package is doffed.

The underwinding sleeve 17, which is fitted so as to idle on the spindle 18 and has a substantially truncated-cone shape to assemble the underwinding coils, cooperates with the lower hollow 123 of the spacer ring 22.

The underwinding sleeve 17 comprises a lower terminal safety flange 27 to retain the underwinding coils.

We claim:

1. A method to wind down a yarn package, on a spinning machine having a spindle to rotate the yarn package in a spinning direction, means to wind yarn on the yarn package and drafting rolls to feed the yarn, comprising:

forming underwinding coils by rotating the yarn package on the spindle in a direction opposite to the spinning direction.

2. A method according to claim 1, further comprising halting the drafting rolls so as to stop yarn feed prior to the step of forming the underwinding coils.

3. A method according to claims 2, wherein the yarn required for winding said underwinding coils is supplied by the yarn package.

4. A method according to claim 3, wherein said machine further comprises an underwinding sleeve, said sleeve having a lower end portion and being rotatably fitted on the spindle, between the yarn package and the spindle, said method further comprising forming said underwinding coils on said underwinding sleeve.

5. A method according to claim 4, further comprising winding the underwinding coils on the underwinding sleeve in an opposite direction relative to the spinning direction.

6. A method according to claim 5, further comprising unwinding the yarn from the yarn package simultaneously with the formation of the underwinding coils.

7. A method according to claim 6, wherein said machine further comprises an annular protruding surface of a spacer ring, with the spacer ring solidly fixed to the spindle between the yarn package and the underwinding sleeve, said method further comprising running the yarn from the yarn package over said annular protruding surface to the underwinding sleeve where it is wound.

8. A method to wind down a yarn package, on a spinning machine having a spindle to rotate the yarn package in a spinning direction, an underwinding sleeve located on said spindle, means to wind yarn on the yarn package, and drafting rolls to feed the yarn, comprising:

diverting the yarn from a position corresponding with an upper end portion of the yarn package to a position corresponding with the underwinding sleeve; and then forming the underwinding coils by rotating the yarn package on the spindle in a direction opposite to the spinning direction.

9. A method according to claim 8, further comprising positioning the diverted yarn, in a stationary manner, in correspondence with the underwinding sleeve.

10. An apparatus for winding down a yarn package comprising:

a spindle to rotate the yarn package; and means to wind yarn on the yarn package; and drafting rolls to feed the yarn to the winding means; and an underwinding sleeve located on said spindle and rotatable relative to the spindle; and a spacer ring, solidly fixed to the spindle above the underwinding sleeve, comprising:

an upper annular hollow end to accommodate the yarn package;

a lower annular hollow end having a substantially sharp annular edge; and an annular protruding surface positioned between the upper and lower ends of said spacer ring.

11. An apparatus according to claim 10, wherein the winding means is transversable along the outer diameter of the yarn package.

12. An apparatus according to claim 11, wherein said underwinding sleeve is substantially truncated-cone shaped and has a lower end portion, said sleeve comprising a lower terminal annular flange to retain the underwinding coils.

13. An apparatus according to claim 12, further comprising a divertive element which cooperates momentarily with the yarn so as to bring the yarn into correspondance with the lower end portion of the underwinding sleeve.

14. An apparatus according to claim 13, wherein the divertive element comprises a pin.

15. An apparatus according to claim 13, wherein the divertive element comprises a lever.

* * * * *